US005438799A

United States Patent [19]

Le Faucheur

[11] Patent Number: 5,438,799

[45] Date of Patent: Aug. 8, 1995

[54] ARRANGEMENT WITH A DEVICE PIVOTING BETWEEN TWO POSITIONS SUCH AS A BARRIER ARRANGEMENT SWINGING BETWEEN A POSITION FORBIDDING THE ACCESS TO A RESERVED AREA AND AN ACCESS CLEARING POSITION

[75] Inventor: Joël R. Le Faucheur, Ableville La Riviere, France

[73] Assignee: Annie C. Kerjan, Ableville La Riviere, France

[21] Appl. No.: 98,419

[22] Filed: Jul. 27, 1993

[30] Foreign Application Priority Data

Jul. 28, 1992 [FR] France ..... 90 09305

[51] Int. Cl.[6] ..... E01F 13/00

[52] U.S. Cl. ..... 49/49; 49/131; 49/334; 49/338

[58] Field of Search ..... 49/49, 131, 334, 338; 404/6, 9

[56] References Cited

U.S. PATENT DOCUMENTS

| | | | |
|---|---|---|---|
| 2,637,920 | 5/1953 | Stratton | 49/49 X |
| 3,673,734 | 7/1972 | Goldberg | 49/131 X |
| 3,748,782 | 7/1973 | Reynolds | 49/131 X |
| 4,658,543 | 4/1987 | Carr | 49/49 X |
| 4,858,382 | 8/1989 | Ellgass | 49/49 X |
| 4,861,185 | 8/1989 | Eikelenboon | 49/131 X |
| 4,879,554 | 11/1989 | Diaz-Silveira | 49/49 X |
| 4,901,071 | 2/1990 | Fletcher | 49/49 X |

FOREIGN PATENT DOCUMENTS

| | | |
|---|---|---|
| 0274352 | 7/1988 | European Pat. Off. . |
| 2124197 | 9/1972 | France . |

*Primary Examiner*—Philip C. Kannan
*Attorney, Agent, or Firm*—Steinberg, Raskin & Davidson

[57] ABSTRACT

An arrangement with a barrier device pivoting between a position preventing the access to a reserved area and an access clearing position, comprising two bow-shaped pivot arms, a drive device for pivoting the barrier device and means for actuating this drive device, wherein the drive device comprises a lever with two arms of different lengths which is mounted for swinging about a pivot device, the short arm being connected to the barrier device for pivoting same when the lever is pivoting about said pivot device whereas the actuating device acts upon the end of the long arm, the invention being applicable to barrier arrangements for car parking places.

20 Claims, 3 Drawing Sheets

III
III
B

ARRANGEMENT WITH A DEVICE PIVOTING BETWEEN TWO POSITIONS SUCH AS A BARRIER ARRANGEMENT SWINGING BETWEEN A POSITION FORBIDDING THE ACCESS TO A RESERVED AREA AND AN ACCESS CLEARING POSITION

BACKGROUND OF THE INVENTION

The present invention relates to an arrangement with a pivoting system swinging between two positions such a swing gate or barrier arrangement pivoting between a position preventing the access to a reserved area and an access clearing position, in particular a barrier appliance for a car parking place or lot for an automotive vehicle, of the type comprising a barrier device with a swinging arm comprising at least one arm and advantageously a device with two bow-shaped or arch-shaped arms, a drive device for pivoting the barrier device and means for actuating this drive device.

Barrier arrangements of this kind are already known. All of them exhibit the major inconvenience that the drive device exhibits a complicated and cumbersome structure comprising for instance a screw threaded rod rotated by an electric motor and in engagement or meshing with a non-rotary nut which under the effect of the rotation of the rod effects a rectilinear axial reciprocating or a back-and-forth motion which causes the barrier to pivot through the medium of a link pivotally connected to the nut and to the barrier device.

OBJECT AND SUMMARY OF THE INVENTION

The object of the present invention is to provide an arrangement which copes with the inconveniences of the known state of prior art.

To reach this goal the arrangement according to the invention is characterized in that the drive device comprises a lever with two arms of different lengths which is mounted for pivoting about a stationary pivot device, the shorter arm is connected to the barrier device for causing it to pivot when the lever is pivoting about the stationary pivot device and in that the actuation device acts upon the end of the longer arm.

According to an advantageous characterizing feature of the invention the drive device comprises means for imparting to the two-arm lever an axial motion component in the direction of the pivot axis of the barrier device which superposes itself upon a pivoting motion of the lever so that the pivoting of the barrier device takes place at first mainly under the effect of the pivoting of the lever and then under the effect of the axial motion thereof.

According to another advantageous characterizing feature of the invention, the barrier device comprises at its pivot axis a cam-shaped member upon which is acting the end of the short arm of the pivoting drive lever and the pivot device is provided as a device bearing upon a stationary surface through an advantageously linear contact area perpendicular to the axis of the lever, this contact zone being displaceable on the support surface in the axial direction of the lever.

According to another advantageous characterizing feature of the invention, the pivot device comprises at least one roller the axis of which extends at right angles to the longitudinal direction of the lever and which is in rolling contact with the support surface.

According to still another advantageous characterizing feature of the invention, the end of the long arm of the lever is bearing upon a surface inclined with respect to the axis of the lever so that a pivoting motion of the end of this lever in the direction of the swinging drive motion of the barrier device towards this blocking position produces the aforesaid axial displacement of the lever.

According to still a further advantageous characterizing feature of the invention, the lever actuating device comprises an electric motor provided with a rotary shaft the angular motion of which causes the pivoting of the lever.

According to still another advantageous characterizing feature of the invention, the actuation device comprises an electromagnet provided with a solenoid the displacement of which causes the pivoting of the lever.

BRIEF DESCRIPTION OF THE DRAWINGS

The invention will be better understood and further objects, characterizing features, details and advantages thereof will appear more clearly as the following explanatory description proceeds with reference to the accompanying diagrammatic drawings given by way of non limiting example only illustrating a presently preferred specific embodiment of the invention and in which.

DETAILED DESCRIPTION OF THE INVENTION

The invention will be described hereinafter by way of example as applied to a barrier arrangement for a car parking place or lot area for an automotive vehicle.

Figure 1:
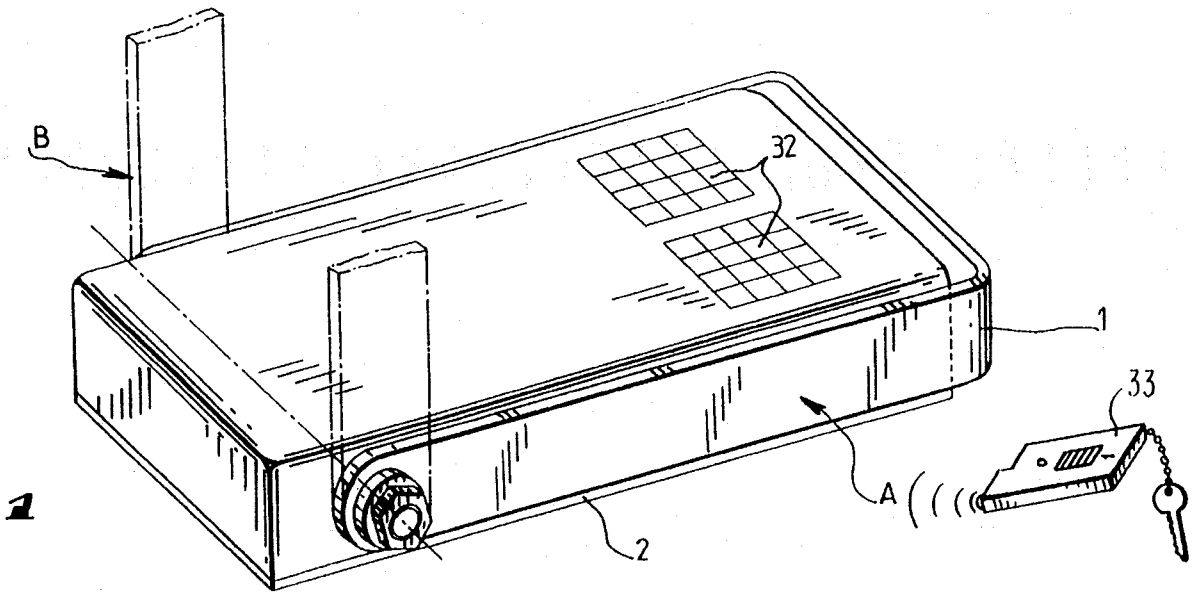
FIG. 1 is a perspective view of the barrier arrangement according to the invention which shows the casing and the barrier device.

FIG. 1 shows the barrier arrangement according to the invention provided as a parallelepipedic flat casing or box A comprising a cover 1 and a bottom plate 2 and to which is pivotally connected a barrier device B. The casing is set into the ground of the car parking area, the upper surface being cleared or free and on a level or in flush registering relationship with the ground.

Figure 4:
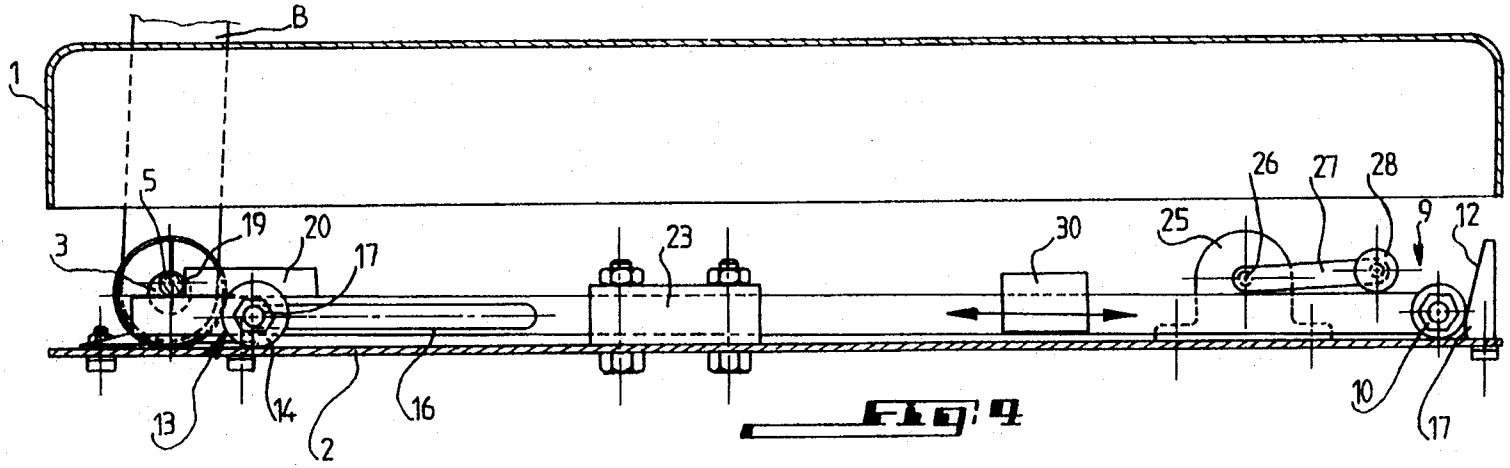
FIG. 4 is a view similar to FIG. 3 but showing the barrier device in its raised or lifted position.
Figures 2, 3:
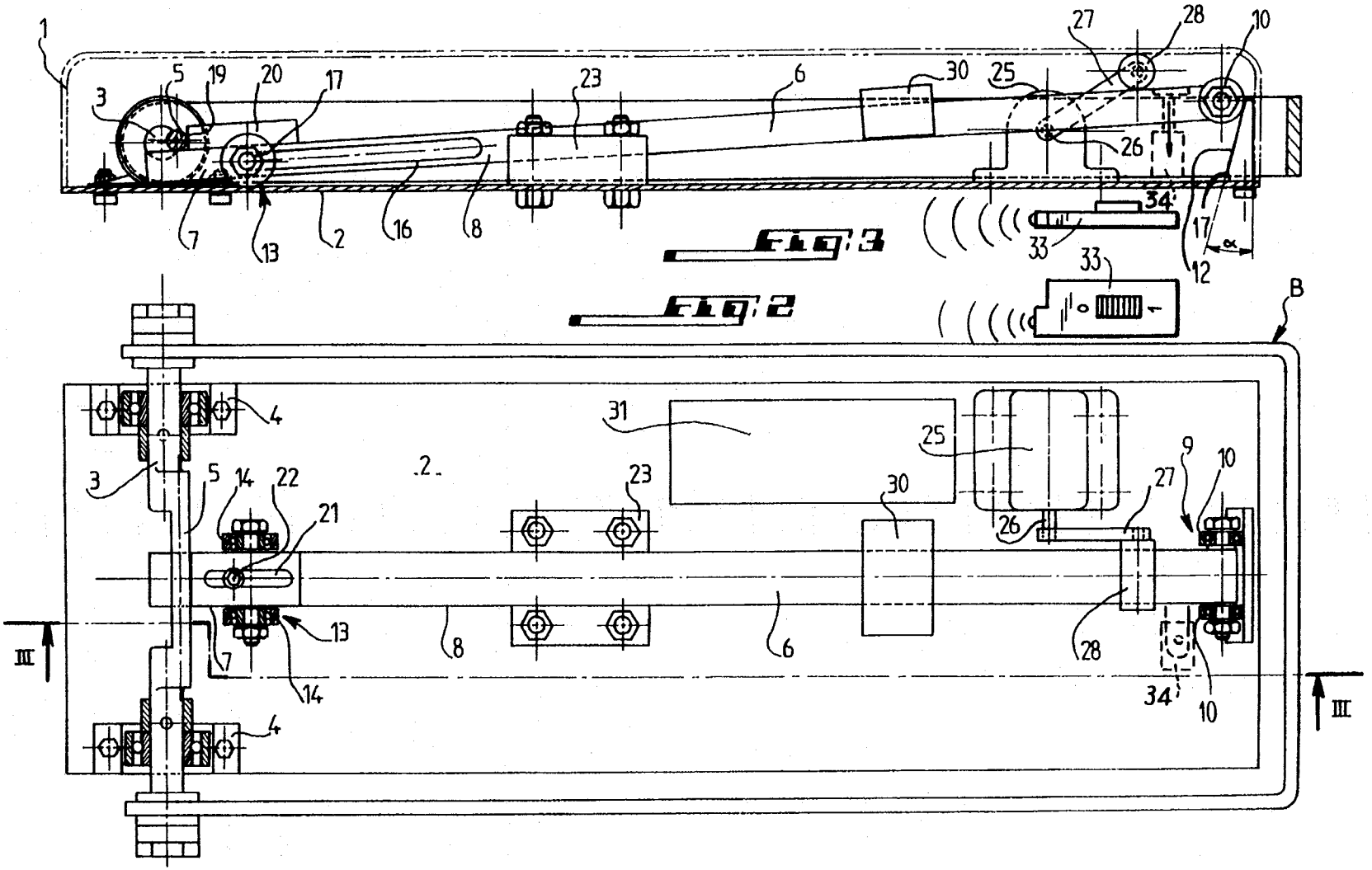
FIG. 2 is a top view of the barrier arrangement according to the invention, the casing being open and the barrier device assuming its retracted position.
FIG. 3 is a view in section taken upon the line III—III of FIG. 2.

As it appears from FIGS. 2 to 4 the barrier device B is made as a bow or arch which is mounted for swinging motion by means of a shaft 3 in bearings 4 fastened onto the bottom plate 2 so that it may swing between a position retracted into the ground and a barring or stopping position in which it blocks the access to a reserved car parking area. The shaft 3 of the bow B comprises in its axially middle part an eccentric cylindrical portion 5 which constitutes an actuating cam for pivoting the bow.

The arrangement also comprises a drive system for pivoting the bow, which essentially comprises a lever 6 with two arms of different lengths which extends longitudinally within the casing. This lever comprises a first shorter arm 7 which co-operates with the eccentric 5 of the pivot shaft of the bow B and a long arm 8 the end of which carries a device 9 with rollers; both rollers 10 of which are mounted on a common shaft perpendicular to the longitudinal direction of the lever on either side of the latter. The rollers are in rolling contact with an inclined ramp surface 12 mounted on the bottom 2 which exhibits an angle $\alpha$ of inclination with respect to a line perpendicular to the bottom of the casing 2, which is relatively small. This ramp surface is slanting with a small slope 17 in the reverse direction in its zone near the bottom in order to produce an effect of blocking the lever when the latter assumes its sunk or depressed position shown on FIG. 4.

The lever 6 comprises a pivot device 13 which in the example shown comprises two rollers 14 rotatably mounted on a same shaft perpendicular to the axis of the lever and located on either side of the latter. The axial position of the pivot device 13 is stationary on the lever 6 since it determines both arms 7 and 8 of the lever. The latter is bearing upon the top face of the bottom of the casing 2 through the medium of these rollers 14. The axial position of the pivot device 13 is variable in axial position on the lever 6 due to an oblong recess 16 formed in the lever and in which the shaft of both rollers 14 is displaceable and may be stopped with the assistance of any known suitable means. The short arm 7 of the lever 6 carries on its top surface upon which is bearing the eccentric 5 of the pivot shaft 3 of the bow B, a shoulder 19 formed of the front face of an inserted member 20; the axial position on the lever arm 7 is adjustable owing to an oblong axial recess 21 formed in the member 20 through which is extending a screw 22 for connection through tightening. Members 23 guide the movement of the lver arm 8.

The device for actuating the lever 6 essentially comprises in the exemplifying embodiment shown a motor 25 with a rotary shaft 26. On the free end of the latter is secured and bound thereto for unitary rotation at one of its ends a radial arm 27 the free end of which carries a journal or trunnion onto which is mounted for free rotation a roller 28 which extends in parallel relation to the shaft 26 and is caused to bear upon the top surface of the end of the long arm 8 of the lever 6 in the portion near the ramp 12.

To complete the description of the barrier arrangement according to the invention, it is seen that there may be provided on the long arm 8 of the level 6 counterweights diagrammatically designated at 30, which are adapted so that the force for operating the lever 6 for the purpose of pivoting it may be very small. To make it possible to adjust the whole system to its state of equilibrium or balance, the axial position of the counterweight 30 could be adjustable on the lever arm 8, illustrated schematically by an arrow.

The electric power supply device is enclosed in the casing and advantageously comprises a rechargeable storage battery diagrammatically designated at 31 and a sun energy pick-up cell shown at 32 on FIG. 1.

The parking place barrier arrangement according to the invention may be remote-controlled for instance by means of a distant radio control contrivance diagrammatically designated as reference numeral 33. The electrical device comprises for that purpose a receiver (not shown) which is also fed with electric power from the sun energy pick-up cell so as to be working or operating for example every three seconds. For that purpose it could be fed with electrical energy for one second every three seconds. The energy generated by the solar pick-up cell during the three seconds where the receiver is inoperative or out of service could be used to recharge the storage battery forming the source of electric energy for the motor 25.

The feed circuit for supplying the motor with electrical energy comprises a fuse with two stable states which is known per se and operates as a switch which is closed in the normal operating condition of the motor and opens when the motor energizing current exceeds a predetermined threshold value. This threshold value is detectable as a heating beyond a predetermined temperature produced by the motor energizing current. Such a heating together with the cut-out of or switching off the feed circuit supplying the motor with electrical energy will occur when the bow during its swinging motion meets with an obstacle opposing it a reaction force exceeding a predetermined value. The bi-stable fuse which has just been described and is mounted in the feed circuit for supplying the motor 25 with energy moreover performs the funtion of a stroke-end limit stop for the motor. Indeed when the lever assumes the position shown on FIG. 4, the angular motion of the rotary shaft 26 of the motor 25 stops and this is sensed by the motor 25 as a reaction torque exceeding the above-mentioned predetermined threshold value thereby causing the opening of the cut-out fuse. As shown on FIG. 3, when the bow assumes its retracted position, the roller 28 of the lever actuating device is bearing upon the internal surface of the casing. Thus when the lever 6 returns from its bow-raising position (FIG. 4) into its retracted position, the angular motion of the shaft 26 of the motor 25 is stopped when the roller 28 comes in bearing engagement with the inner surface of the casing, thereby causing the cut-out fuse to open again in view of the heating due to the increase of the reaction torque which the cover opposes to the angular motion of the output shaft 26 of the motor.

The operation of the barrier arrangement of the invention which has just been described and shown on the figures and which already results in its principle from the foregoing will be described briefly hereinafter.

When the driver of the automotive vehicle who is allowed to park his vehicle on the car parking area fitted with the arrangement according to the invention is moving near this zone, he emits by means of his remote-control apparatus a signal the duration of which is long enough to coincide with a period during which the receiver is fed with energy from the solar pick-up cell. Since in the example shown the receiver is fed for one second out of three, the driver is sure that the receiver receives the signal emitted by the remote-control apparatus if the duration of the actuation of this apparatus exceeds the duration of four seconds. In reply to the receiving of this remote-control signal, the receiver generates a signal resulting in the feeding of the motor with electrical energy from the storage battery. The motor will thus be supplied with energy in order that it may cause the lever 6 to pivot from its bow lifting position shown on FIG. 4 to the position shown on FIG. 3 in which the bow clears the access to the car parking area. As described hereinabove in this position the switch-off fuse opens the motor feeding circuit. If upon having cooled down the switch-off fuse closes the feed circuit again, the supply of the motor is not resumed without a previous new signal from the receiver. When the authorized driver wants later to operate the raising of the barrier bow, he will perform the same operating cycle and the proper pivoting motion will take place subsequent to a proper remote-control signal until the opening of the motor energizing circuit when the lever reaches the position shown on FIG. 4. The lever is blocked in this position by the concurrent action of the locking portion 17 of the ramp 12 and the stopping of the drive shaft in the angular stroke-end position.

Figure 5:
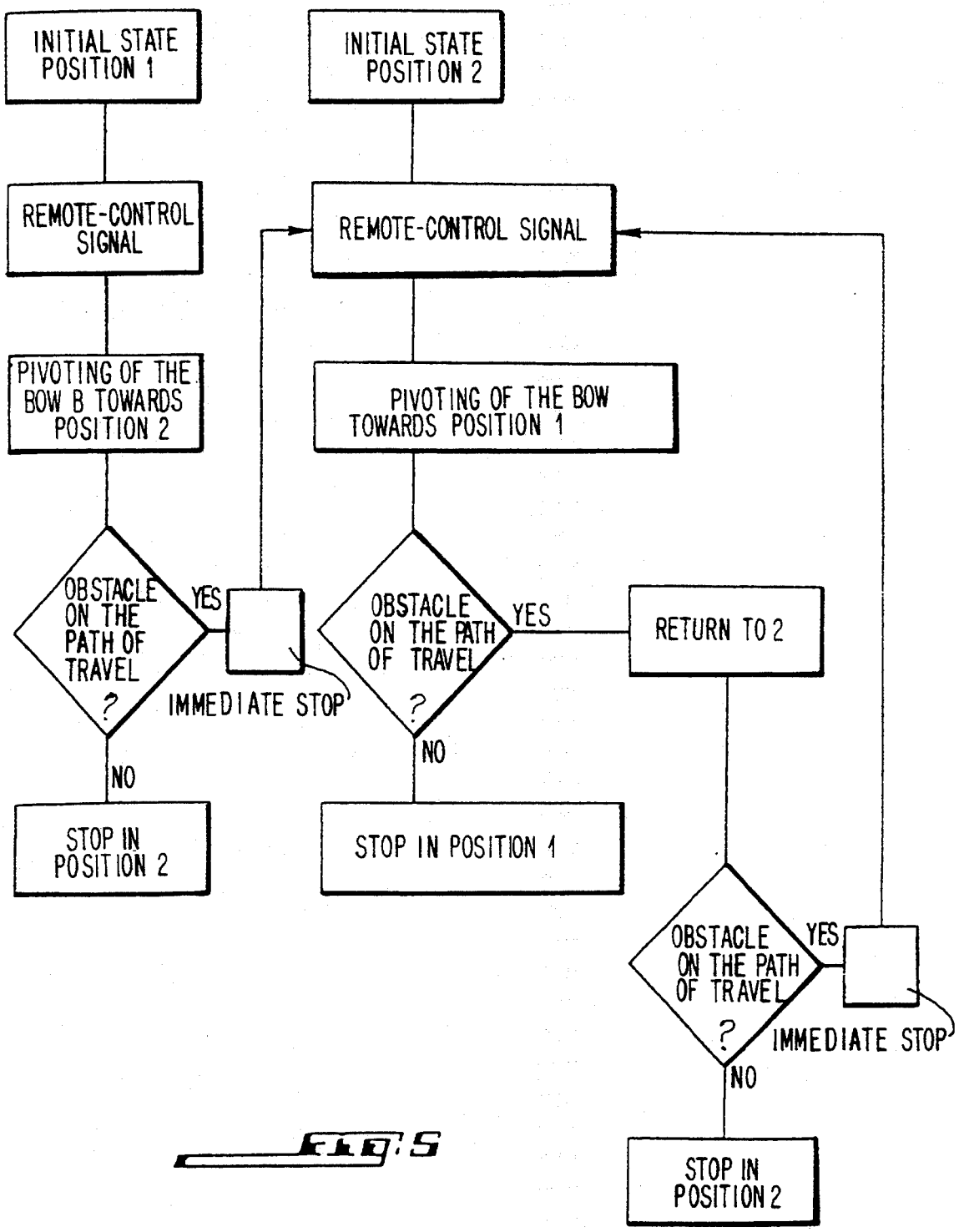
FIG. 5 is a block diagram showing the operating or process chart of the control logic of the barrier arrangement according to the invention.

If during a pivot motion, the bow encounters an obstacle on its path of travel, it is forthwith stopped in its pivoting position under the effect of the switch-off fuse. In reply to a new remote-control signal, the motor will attempt to move the bow back into its starting position. If during this movement the bow is opposed to another obstacle, it stops forthwith and a new remote-control signal will attempt to bring the bow back into the position aimed at initially. If the initial obstacle is still present or if during this travel another obstacle opposes the bow, it results therefrom again the immediate stopping of the pivot motion of the bow. The block diagram or flow chart of FIG. 5 illustrates what has just been described and the control logic of the electrical device of the arrangement of the invention which is the cause thereof.

Upon the description of the structure of the barrier arrangement according to the invention, of its operation and therethrough of the control circuit of the arrangement, the advantages provided by the present invention are easily understood. These advantages reside in particular in the very simple and extremely compact or not very cumbersome construction of this arrangement. In view of the axial displacement component of the lever which superposes itself upon the pivot motion, the pivot angle may be kept at a relatively small value thereby reducing the height of the casting to a very reduced value. The use of the lever fitted as need be with a counterweight makes it possible to reduce to a relatively small value the force necessary for the actuation of the lever for pivoting same. Owing to this fact the motor consumes little energy and the arrangement may be fully self-contained when the solar energy pick-up cells is added. Owing to the use of the cut-out fuse with two states, the arrangement of the invention does not require peculiar stroke-end limit stops for causing a specific stopping in case of the presence of an obstacle. All these functions are performed by this cut-out fuse mounted in the motor feed circuit.

Various modifications may of course be brought to the arrangement which has just been described and is shown. Thus the electric motor could be replaced by any other suitable actuation device such for example as an electromagnet 34, as shown in FIGS. 2, 3 and 4, for instance with a solenoid with two stable positions in which it bears against a surface of the lever arm 8. It is readily understood that the arrangement may also be operated by a manual control in case of absence or of failure of the actuating drive device.

In order to obtain that in its raised position the bow be retracted when a force greater than a predetermined threshold acts thereupon, the bow could be connected at each end of its pivoting arms to the shaft 3 by means of a self-severing pin the diameter of which will be dimensioned in accordance with this threshold.

The invention is generally applicable to any arrangements comprising a lever and a pivoting device. For example the invention is applicable to arrangements of the hoist or elevator type comprising a device such as a platform which is caused to move between a lowered position and a lifted position. In this case the platform will be pivotally connected to the free end of the device B with a pivoting arm and the latter will be associated with a second arm or parallel pivoting device which forms together with the first one a parallelogram ensuring that the plateform carries out a translatory motion. The invention could also be applied to a dump body of a truck or lorry.

What is claimed is:

1. A barrier arrangement, comprising a barrier having at least one arm, means for mounting said barrier for rotation about a pivot axis between a raised position and a lowered position, drive means for pivoting said barrier about said barrier pivot axis, said drive means comprising an elongate lever, actuating means for actuating said drive means, and pivot means coupled to said lever for supporting said lever for pivoting about a pivot axis extending substantially parallel to said barrier pivot axis, a first lever arm being defined between said lever pivot axis and a first end of said lever and a second lever arm being defined between said pivot axis and a second end of said lever opposed to said first end, said first lever arm being smaller than said second lever arm, said drive means further comprising means for imparting a force to said second lever arm for causing said lever to pivot about said lever pivot axis, said first lever arm being in operative engagement with said barrier such that upon pivoting of said lever about said lever pivot axis, said barrier pivots about said barrier pivot axis.

2. In a barrier arrangement including a barrier device having at least one arm adapted to pivot between a raised position preventing access to an area and an access clearing position, such as a vehicle parking area, the barrier device being mounted pivotally about a pivot axis supported in a stationary structure, a drive device coupled to the barrier device for causing the barrier device to pivot about said barrier pivot axis, and means coupled to said drive device for actuating said drive device, the means for actuating the drive device being arranged in the stationary structure, wherein the improvement comprises:

a pivot device for supporting a two-arm lever for pivoting about a pivot axis extending substantially parallel to said barrier pivot axis, said drive device comprising an elongate two-arm lever supported in the stationary structure by said pivot device such that said lever pivots about said pivot axis of said pivot device, said lever being coupled to said pivot device to define a first lever arm between said lever pivot axis and a first end of said lever and a second lever arm between said pivot axis and a second end of said lever opposed to said first end, said first lever arm being smaller than said second lever arm, said first lever arm being coupled to the barrier device for causing the barrier device to pivot about the barrier pivot axis when said lever pivots about said lever pivot axis, said drive device further comprising means for imparting a force to said second lever arm for causing said lever to pivot about said lever pivot axis.

3. A barrier arrangement according to claim 2, wherein the means for actuating the drive device comprise an electric motor provided with a rotary shaft, the angular motion of said rotary shaft causing said lever to pivot.

4. A barrier arrangement according to claim 3, further comprising a roller coupled to said rotary shaft, said roller bearing upon an upper surface of said lever.

5. A barrier arrangement according to claim 2, wherein the drive device further comprises means for imparting axial motion to said lever in a longitudinal direction of said lever relative to said barrier pivot axis in conjunction with the pivoting of said lever about said lever pivot axis such that the pivoting of the barrier device toward the raised access preventing position is produced by the pivoting motion of said lever and by the axial motion of said lever.

6. A barrier arrangement according to claim 5, wherein said axial motion imparting means comprise a ramp-like surface arranged in the stationary structure and inclined with respect to a plane extending substantially perpendicular to said lever, said second lever end bearing upon said ramp surface such that upon movement of said second lever end against said ramp surface, said lever is displaced in the longitudinal axial direction relative to said barrier pivot axis.

7. A barrier arrangement according to claim 6, wherein said ramp surface comprises means for locking the barrier device in the access preventing position, said means comprising a sloping zone arranged in one portion of said ramp surface with which said lever engages when in the access preventing position, said sloping zone being inclined opposite to the inclination of a portion of said ramp surface other than said sloping zone.

8. A barrier arrangement according to claim 5, further comprising a shaft to which the arm of the barrier device is connected and through which said barrier pivot axis extends, said shaft comprising a cam-like member, said first lever arm being in operative engagement with said cam-like member, and a support surface arranged in the stationary structure for supporting said pivot device, said support surface extending substantially in an axial direction of said lever, said pivot device comprising bearing means arranged on said support surface and displaceable on said support surface in a direction parallel to the axial direction of said lever.

9. A barrier arrangement according to claim 8, wherein said bearing means comprise at least one roller having an axis extending substantially perpendicular to the longitudinal axial direction of the lever, said at least one roller being in rolling contact with said support surface.

10. A barrier arrangement according to claim 8, further comprising a member adjustably connected to said lever in proximity to said first lever end, said cam-like member engaging with a shoulder of said member closest to said first lever end such that axial movement of said lever and said member connected thereto imparts rotational movement of said cam-like member of said shaft and thus the arm of the barrier device connected to said shaft.

11. A barrier arrangement according to claim 8, wherein the pivot device comprises at least one roller rotating about an axis extending perpendicular to the longitudinal direction of said lever, said roller being in rolling contact with said support surface.

12. A barrier arrangement according to claim 11, wherein said lever comprises a longitudinal recess formed therein, said pivot device further comprising a shaft connected to said at least one roller of said pivot device, said shaft being movable in said recess in the axial direction of said lever.

13. A barrier arrangement according to claim 2, wherein the means for actuating the drive device comprise an electromagnet provided with a displaceable solenoid bearing against said lever, the displacement of said solenoid causing said lever to pivot.

14. A barrier arrangement according to claim 2, further comprising an adjustable counterweight arranged on said second lever arm, the axial position of said counterweight on said lever is adjustable to provide a composition effect to the weight of the barrier device.

15. A barrier arrangement according to claim 2, wherein the means for actuating the drive device comprise means for stopping the pivoting motion when the barrier device encounters an obstacle.

16. A barrier device according to claim 2, further comprising a remote-control device coupled to the means for actuating the drive device for initiating actuation of the same.

17. A barrier device according to claim 2, further comprising a device for feeding the means for actuating the drive device with electrical energy, said feeding device comprising a rechargeable storage battery and solar energy pick-up cells coupled thereto, said pick-up cells constituting a source of electrical energy for feeding electrical circuits of the means for actuating the drive device and for recharging said storage battery.

18. A barrier arrangement according to claim 17, further comprising a remote-control device coupled to the means for actuating the drive device for initiating actuation of the same, wherein said pick-up cells feed said remote-control device with energy.

19. A barrier arrangement according to claim 2, wherein said stationary structure comprises a housing in which the means for actuating the drive device and said pivot device are arranged, said housing being defined by a cover member and a bottom plate.

20. The arrangement of claim 2, wherein the barrier device has two bow-shaped arms.

* * * * *